United States Patent [19]

Chaur Ching et al.

[11] Patent Number: 4,930,584

[45] Date of Patent: Jun. 5, 1990

[54] CRACKING DEVICE

[75] Inventors: Lai Chaur Ching, Kaohsiung City; Huang Wen Ho, Tainan Hsien, both of Taiwan

[73] Assignee: Easy Industries Co., Ltd., Kaohsiung, Taiwan

[21] Appl. No.: 347,083

[22] Filed: May 4, 1989

[51] Int. Cl.[5] ..... B25D 9/18

[52] U.S. Cl. ..... 173/116; 91/300; 173/133; 37/DIG. 18

[58] Field of Search ..... 173/116, 133, 125; 92/290, 300, 321

[56] References Cited

U.S. PATENT DOCUMENTS

| | | | |
|---|---|---|---|
| 4,230,019 | 10/1980 | Castan | 91/321 |
| 4,646,854 | 3/1987 | Arndt et al. | 91/321 X |
| 4,784,228 | 11/1988 | Ito | 91/290 X |
| 4,817,737 | 4/1989 | Hamada et al. | 91/290 X |

FOREIGN PATENT DOCUMENTS

| | | | |
|---|---|---|---|
| 1916860 | 10/1970 | Fed. Rep. of Germany | 91/300 |
| 2611327 | 10/1976 | Fed. Rep. of Germany | 91/300 |

*Primary Examiner*—Randolph A. Reese
*Assistant Examiner*—Arlen L. Olsen
*Attorney, Agent, or Firm*—Sughrue, Mion, Zinn, Macpeak & Seas

[57] ABSTRACT

A cracking device for use in a dredger includes a housing body having an elongated cavity receiving an elongated piston and a hammer rod to be struck by the piston. The cavity forms a gas chamber around a top end of the piston for receiving an operating gas, an annular hydraulic chamber around the piston adjacent to the annular flange, and an impact chamber around a bottom end of the piston and around a top end of the hammer rod. The hydraulic chamber is divided into two variable volume upper and lower chambers by an annular flange of the piston. A passage is provided in the body to permit a hydraulic fluid to operate in the hydraulic chamber through the passage. A hydraulically operated control valve is connected to the passage and the hydraulic chamber for controlling the operation of the hydraulic fluid.

1 Claim, 4 Drawing Sheets

CRACKING DEVICE

BACKGROUND OF THE INVENTION

This invention relates to a craking device used in combination with a dredger and particularly to a cracking device which is operated hydraulically.

A cracking device attached to a dredger is usually used to demolish rock, stone, buildings, bridge, etc. Conventionally, cracking devices of the type mentioned above are operated electrically by means of a motor and are suitable to be used where electrical connections can be accomplished conveniently. Such cracking devices must be installed via a complicated process before the device can perform properly. Moreover, the striking force created by such cracking devices is limited since the force is imparted by means of the returning action of a spring.

SUMMARY OF THE INVENTION

According to the present invention, a cracking device for use in a dredger comprises, a housing body having an elongated cavity opening at one side of the cavity. An elongated piston is provided movably in the cavity and has an annular flange around an intermediate portion of the piston, the annular flange having an upper bearing face and a lower bearing face. A hammer rod is mounted in the cavity and has a portion thereof extending outward. The cavity forms a gas chamber around a top end of said piston, an annular hydraulic chamber around the piston adjacent to the annular flange, and an impact chamber around a bottom end of the piston and around a top end of the hammer rod. The hydraulic chamber is divided into two variable volume upper and lower chambers by the annular flange of the piston. A gas is provided in the gas chamber to act on the top end of the piston upon expansion after compression. A hydraulic fluid is provided in the hydraulic chamber to act on the upper and lower bearing faces so as to move the piston upward and downward. A passage means is provided in the body to permit the hydraulic fluid to operate in the hydraulic chamber through the passage means. A hydraulically operated control valve is connected to the passage means and the hydraulic chamber for controlling the operation of the hydraulic fluid.

An object of the invention is to provide an improved cracking device which is operated hydraulically and which can provide an effective cracking force.

Another object of the invention is to provide an improved cracking device which includes a hydraulically operated piston to strike a hammer rod which acts directly on an object and which can absorb the shock produced when the piston is forced to move rapidly downward to strike the hammer rod. The shock absorbing effect is achieved by letting a large portion of the fluid flowing from the high pressure chamber into the lower pressure chamber to minimize the change in pressure in a low pressure outlet passage.

The present exemplary preferred embodiment will be described in detail with reference to the accompanying drawings, in which:

DETAILED DESCRIPTION OF THE PREFERRED EMBODIMENT

Figure 1:
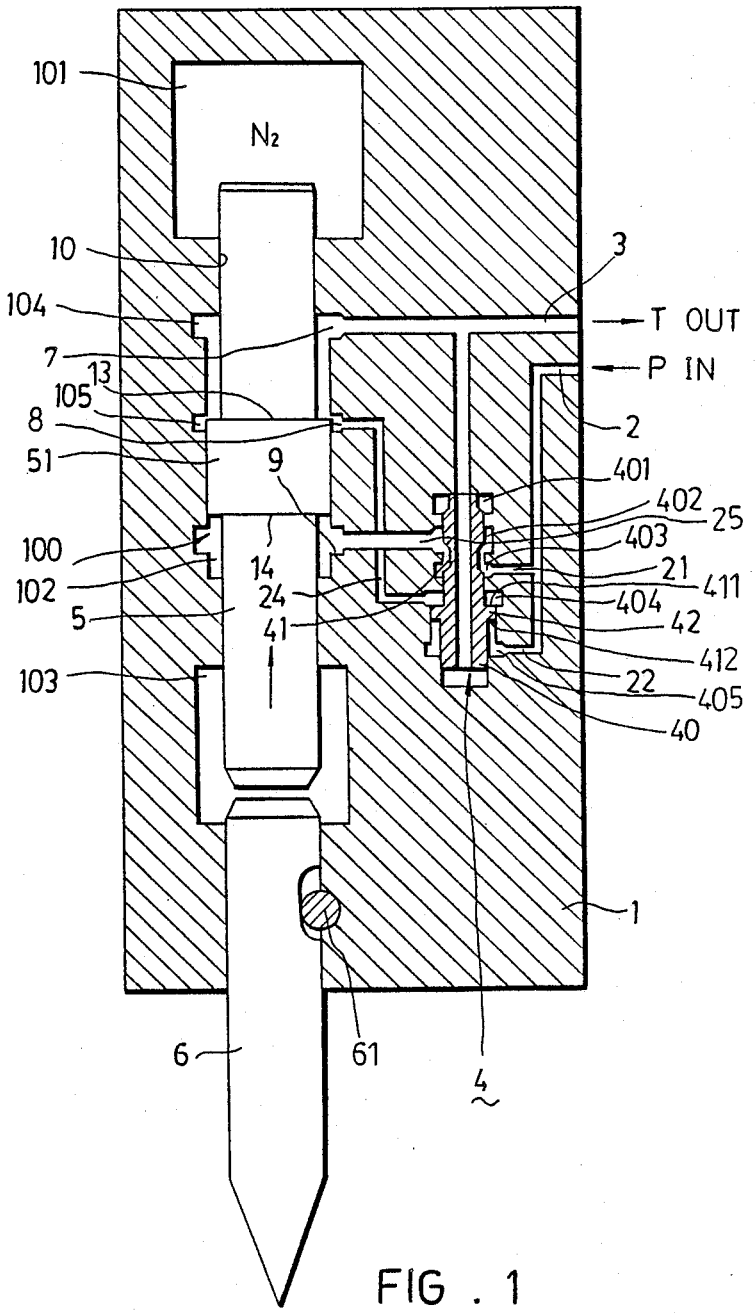
FIG. 1 is a schematic view of a cracking device according to the present invention in a position in which the piston begins to move upward.

Referring to the drawings, a crushing device according to the present invention is shown, having a body 1 which is provided with a longitudinal interior cavity 10 receiving a piston 5 which has an intermediate flange 51 with an upper bearing face 13 and a lower bearing face 14, and a hammer rod 6 to be struck by the piston. The cavity 10 forms a gas chamber 101 adjacent to the top end of the piston 5, a hydraulic chamber 100 around the piston 5 adjacent to the flange 51 and an impact chamber 103 around the bottom end of the piston 5 and the top end of the hammer rod 6. The hydraulic chamber 100 is divided into upper and lower variable volume chambers by the flange 51 and includes a lower pressure region 104, a control region 105 and a high pressure region 102. Ports 7, 8 and 9 are provided in the hydraulic chamber 100. The gas chamber 101 is filled with a nitrogen gas.

A hydraulic passage means is formed in the body 1 for the flow of an operating hydraulic fluid. The passage means includes a high pressure fluid passage 2 and a low pressure fluid passage 3. The high pressure fluid passage 2 has a first branch passage 21 and a second branch passage 22. A control valve 4 is provided to control the operation of the fluid in the passages and the hydraulic chamber.

The control valve 4 includes a valve casing and an elongated plug member 40 having different crosssections. The plug 40 has a restricted portion 41 and a flange 42 which has an upper bearing face 411 and a lower bearing face 412. The valve casing has a cavity which defines, around the plug member 40, a low pressure region 401, a region 402, an upper high pressure region 403 connected to the branch 21, a control region 404 communicated with the region 105 of the hydraulic chamber through a passage 24 and a lower high pressure region 405 connected with the branch passage 22. The valve plug 40 can move upward and downward by means of the action of the hydraulic fluid to cause the above mentioned regions of the control valve to communicate and discommunicate the inlet or outlet passage 2 or 3 and the inlet or outlet port of the hydraulic chamber 100. The operation of the cracking device is described hereinunder.

After the hammer rod 6 is pressed against an object, the hammer rod 6 reacts on the piston 5, causing the piston 5 to move upward as shown in FIG. 1. At the same time, the high pressure fluid is let into the chamber 403 of the control valve 4 through the branch passage 21, causing the plug 40 to move upward. When the plug 40 moves upward, the chamber 403 communicates with chamber 402 and then chamber 102 of the hydraulic chamber through the passage 25, permitting the high pressure fluid to flow into the chamber 102. The high pressure entering fluid acts on the bearing face 14 of the piston 5 with a force which is greater than the pressure of the gas in the chamber 101, thus moving the piston 5 upward after the action of the striking rod on the piston 5. While the piston is moved upward, the fluid in the regions 105, 104 is forced to flow out through the passage 3 and the outlet T to a hydraulic tank (not shown). In this situation, the gas in the chamber 101 is compressed.

Figure 2:
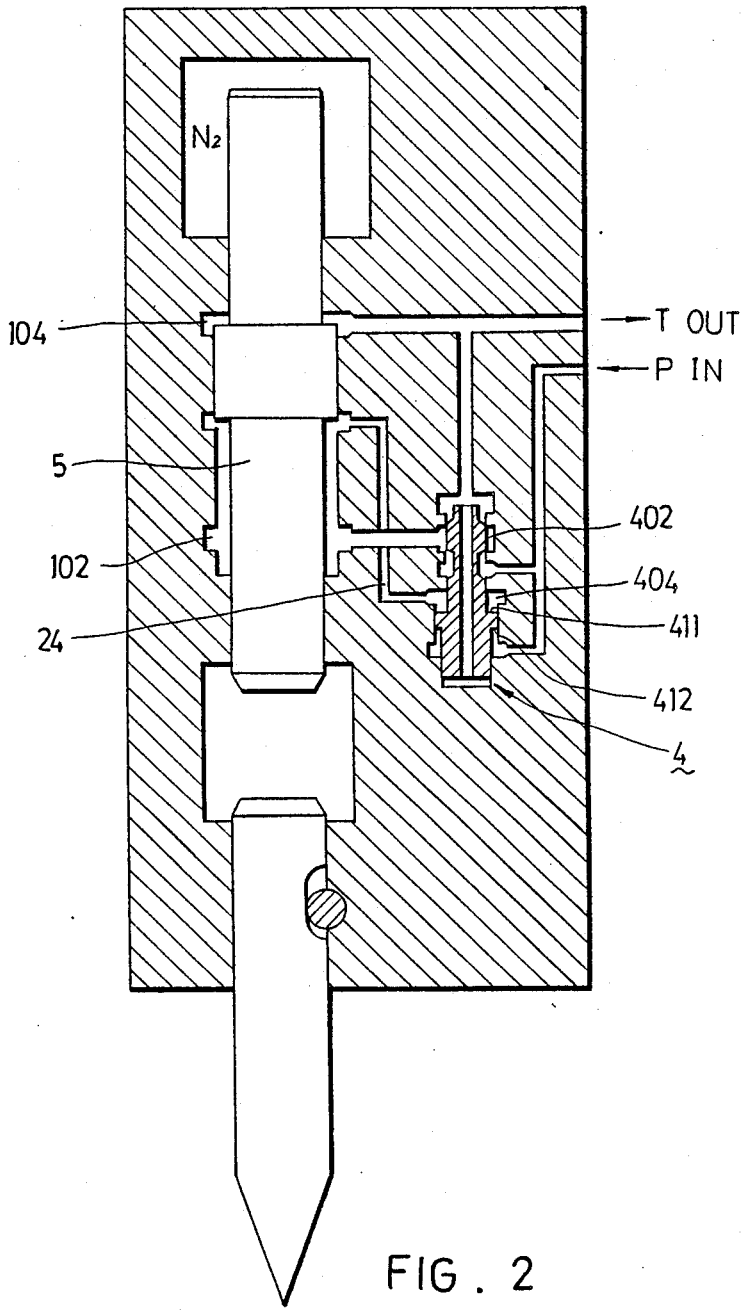
FIGS. 2 to 4 show schematically the cracking device in different positions.

When the piston 5 moves to the end of the upward stroke of the piston 5 as shown in FIG. 2, the chamber 102 communicates with the chamber 105, and the fluid therein flows to the passage 24, then to the chamber 404 of the control valve 4 and acts on the bearing face 411 of the valve plug 40. Since the annular bearing face 411 of the valve plug is greater than the annular bearing face 412, the pressure on the bearing face 411 forces the valve plug 40 to move downward, thereby interrupting the inlet flow of the fluid through the communication between the passage 21 and the chamber 402.

Figure 3:
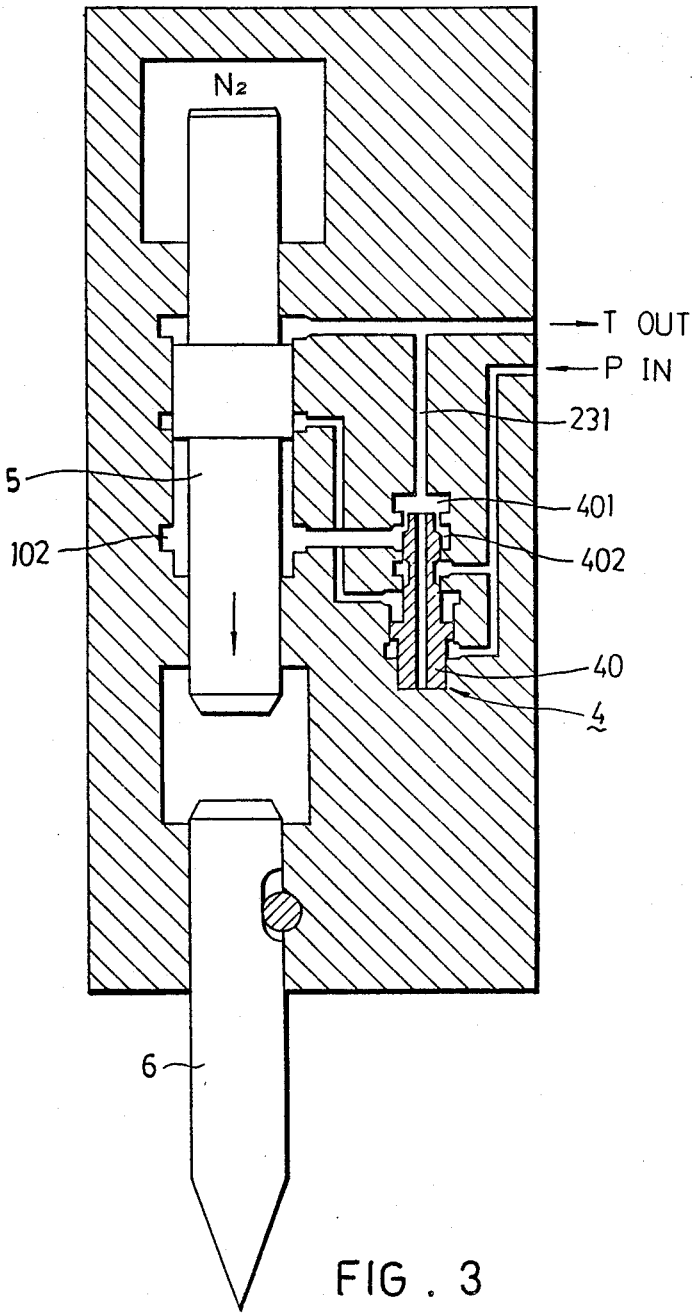

When the valve plug 40 reaches the lowest limit point as shown in FIG. 3, the chamber 102 communicates, through the passage 25 and the chamber 402, with the chamber 401 of the control valve 4 which in turn communicates with the passage 3 through the passage 231, thus permitting the fluid in the chamber 102 to flow to the outlet T. In this situation, the piston 5 rapidly moves downward due to the decreased pressure in the chamber 102 and the expansion of the compressed gas in the chamber 101. The rapidly descending piston 5 strikes the rod 6 which in turn provides an impact pressure on the object, as shown FIG. 4. The movement of rod 6 relative to body 1 is limited by an element 61.

The high pressure fluid flowing towards the passage 3 due to the rapid descent of the piston separates into two streams at the end of the passage 231, one stream flowing outward through the passage 3 and the outlet T and the other flowing into chamber 104 of the hydraulic chamber. This arrangement reduces the change in pressure in the low pressure passage 3 and thus minimizes the shock which will be caused to the lower pressure passage 3 and the accessories (not shown) connected with the passage 3 outside the body of the present device.

Figure 4:
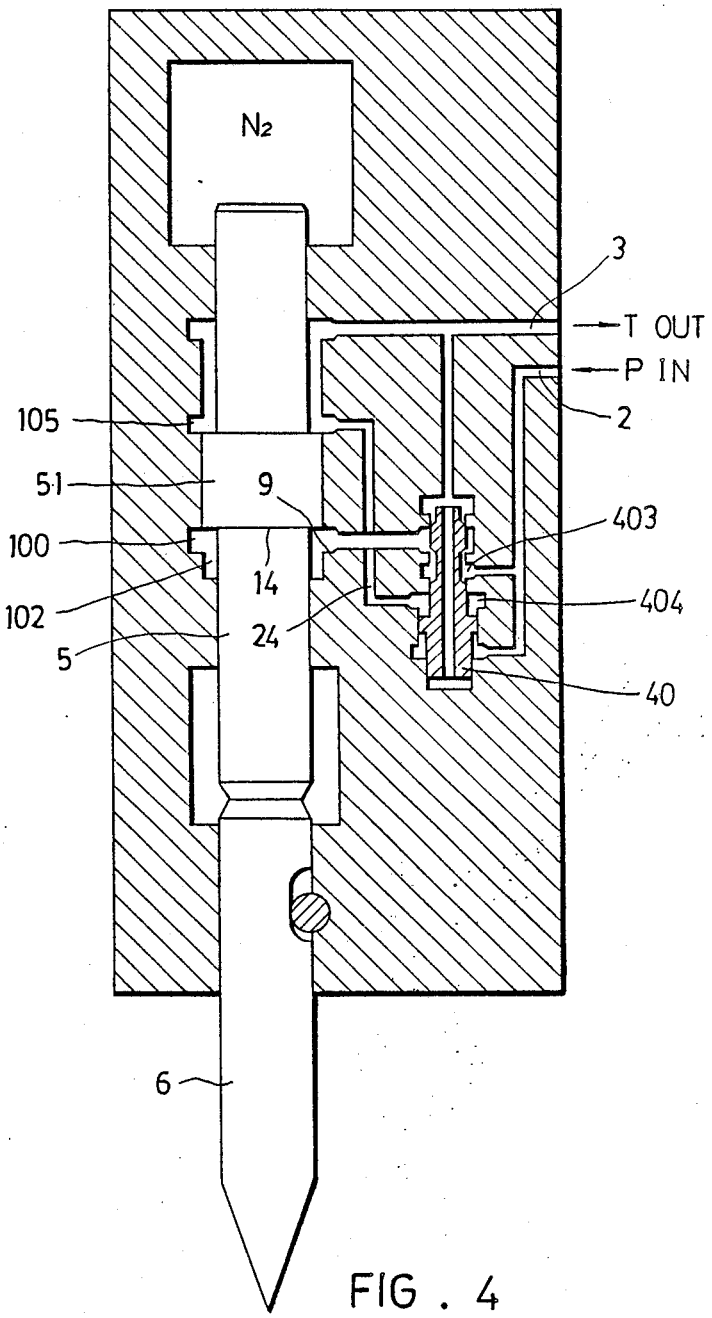

While the fluid in the chamber 102 flows outward through the passage 25, a flow of fluid is admitted in the chamber 105 through the passage 24 since the valve plug 40 which has descended to its lower limit point permits the chamber 403 of the control valve 4 to communicate with the chamber 404 and the passage 24 as shown in FIG. 4. The excess fluid pressure in the chamber 105 can be released through the passage 3 which is communicated with a hydraulic tank of the dredger (not shown) to which the present device is attached. Since the fluid in the chamber 404 is released through the passage 24, the pressure acting on the bearing face 411 is removed and the valve plug 4 is allowed to move upward.

The piston 5 moves upwards after it strikes the hammer rod 6 and will ascend and strike the hammer rod 6 again in the way mentioned above. The operation of the device can be repeated until the object cracks. At the end of the operation, the hammer rod 6 is at the lowest position thereof so that the piston 5 falls to a position in which the lower bearing face 14 of the flange 51 reaches the bottom end of the hydraulic chamber 100, thereby closing the port 9 which communicates with the passage 25.

With the invention thus explained, it is apparent that various modifications and variations can be made without departing from the scope of the invention. It is therefore intended that the invention be limited only as indicated in the appended claims.

What I claim is:

1. A cracking device comprising;

a housing body having an elongated cavity opening at one side of said cavity;

an elongated piston provided movably in said cavity and having a single first annular flange around an intermediate portion of said piston, said first annular flange having an upper bearing face and a lower bearing face;

a hammer rod having a portion, mounted in said cavity, and a remaining portion extending outward;

said cavity forming a gas chamber around a top end of said piston, an annular hydraulic chamber around said piston adjacent to said first annular flange, and an impact chamber around a bottom end of said piston and around a top end of said hammer rod; said hydraulic chamber having a low pressure region (104), a high pressure region (102) and a control region (105) between said low and high pressure regions; said first annular flange moving between said low and high pressure regions during the operation of said piston;

a gas provided in said gas chamber to act on said top end of said piston;

an hydraulic fluid for operating in said hydraulic chamber;

a low pressure fluid outlet port (T) provided in said housing;

a high pressure fluid inlet port (P) provided in said housing;

a valve cavity provided in said housing adjacent to said piston;

a control valve provided in said valve cavity, said control valve being movable between a first position and a second position, said first position permitting a fluid communication between said high pressure region and said high pressure fluid inlet port after said piston strikes said hammer rod, said second position permitting a fluid communication between said high pressure region and said low pressure region after said elongated piston reaches an upper limit level, and at the same time, permitting the hydraulic fluid to flow from said high pressure region to said low pressure fluid outlet port;

said control valve having an outward second annular flange (42) which has a first annular bearing face (411) and a second annular bearing face (412) opposite to said first annular bearing face, said first bearing face having an area greater than that of said second bearing face;

said valve cavity having a first valve chamber portion around said second annular flange, said second annular flange dividing said first valve chamber portion into first and second variable volume regions (404, 405), said valve cavity further having a second, a third and a fourth valve chamber portion, said second and third valve chamber portions being arranged between said first and fourth valve chamber portions;

a first fluid passage (3) intercommunicating said low pressure region (104) and said low pressure fluid outlet port (T);

a second fluid passage (24) intercommunicating said control region (105) and the one (404) of said variable volume regions which is adjacent to said first annular bearing face (411) of said second annular flange (42);

a third fluid passage (25) intercommunicating said high pressure region (102) and said second chamber portion (402) of said valve cavity;

a fourth fluid passage (2) intercommunicating said high pressure fluid inlet port (P) and said valve cavity, and having a first branch passage (21) communicated with said third chamber portion (403) and a second branch passage (22) communicated with the other (405) of said variable volume regions of said first valve chamber portion; and a fifth fluid passage (231) intercommunicating said first fluid passage and said fourth valve chamber portion (401) of said valve cavity;

said second branch passage directing the hydraulic fluid from said high pressure inlet port to said other variable volume region (405) of said valve cavity so as to act on said second bearing face of said control valve, thereby moving said control valve towards said first position;

said second fluid passage directing the hydraulic fluid to flow from said high pressure region of said hydraulic chamber to said one variable volume region of said valve cavity to act on said first bearing face of said control valve so as to move said control valve to said second position; and said third fluid passage (25) communicating with said first fluid passage through said fifth passage when said control valve is in said second position, thereby permitting the hydraulic fluid to flow from said high pressure region to said low pressure region.

* * * * *